United States Patent [19]

Kubota et al.

[11] 4,148,637

[45] Apr. 10, 1979

[54] SILANE COUPLING AGENT IN PROTECTIVE LAYER OF PHOTOCONDUCTIVE ELEMENT

[75] Inventors: Tomio Kubota; Akio Kojima; Yoshikazu Kaneko, all of Tokyo, Japan

[73] Assignee: Ricoh Co., Ltd., Tokyo, Japan

[21] Appl. No.: 757,591

[22] Filed: Jan. 7, 1977

[30] Foreign Application Priority Data

| | | | |
|---|---|---|---|
| Sep. 4, 1973 | [JP] | Japan | 48-98804 |
| Nov. 23, 1973 | [JP] | Japan | 48-131417 |
| Dec. 24, 1973 | [JP] | Japan | 49-143439 |
| Dec. 25, 1973 | [JP] | Japan | 49-4022 |
| Dec. 25, 1973 | [JP] | Japan | 49-4023 |
| Dec. 25, 1973 | [JP] | Japan | 49-4024 |
| Jan. 14, 1974 | [JP] | Japan | 49-7230 |

Related U.S. Application Data

[63] Continuation of Ser. No. 503,085, Sep. 4, 1974, abandoned.

[51] Int. Cl.[2] ..... G03G 5/14

[52] U.S. Cl. ..... 96/1.5 N; 428/447

[58] Field of Search ..... 96/1.8, 1.5, 1.5 C, 96/1.5 N; 428/447

[56] References Cited

U.S. PATENT DOCUMENTS

| | | | |
|---|---|---|---|
| 3,140,174 | 7/1964 | Clark | 96/1.8 |
| 3,146,145 | 8/1964 | Kinsella | 96/1.5 X |
| 3,251,686 | 5/1966 | Gundlach | 96/1.5 |
| 3,312,547 | 4/1967 | Levy | 96/1.5 |
| 3,317,315 | 5/1967 | Nicoll et al. | 96/1.5 X |
| 3,453,106 | 7/1969 | Teague | 96/1.5 |
| 3,607,258 | 9/1971 | Hoegl et al. | 96/1.5 |
| 3,619,153 | 11/1971 | Lipani | 96/1.5 |
| 3,713,820 | 1/1973 | Champ et al. | 96/1.8 X |
| 3,753,709 | 8/1973 | Standenmayer et al. | 96/1.5 |
| 3,867,139 | 2/1975 | Yamada et al. | 96/1 PC |
| 3,971,660 | 7/1976 | Staehle | 96/33 |
| 4,062,681 | 12/1977 | Lewis et al. | 96/1.5 N |

OTHER PUBLICATIONS

Union Carbide Product Information Bulletin No. F42713A, "Silicone Additives", pp. 1 & 6, Oct. 1970.

*Primary Examiner*—Roland E. Martin, Jr.
*Attorney, Agent, or Firm*—Cooper, Dunham, Clark, Griffin & Moran

[57] ABSTRACT

The present invention provides a photosensitive material for use in electrophotography which comprises a conductive support having a photoconductive layer coated with a protective layer, the material being superior in light-decay property, mechanical strength and image formability, wherein said protective layer is composed of either (1) a member selected from the group of resins consisting of polyvinyl butyral, polyvinyl acetate, acryl or derivative resins thereof, copolymers of styrene and maleic anhydride or alkyl esters thereof, copolymers of vinyl acetate or derivatives thereof and vinyl pyrrolidone, copolymers of butyl vinyl ether and maleic anhydride or alkyl monoesters thereof and shellac, or of (2) a resin and silane-coupling agent.

8 Claims, 3 Drawing Figures

SILANE COUPLING AGENT IN PROTECTIVE LAYER OF PHOTOCONDUCTIVE ELEMENT

This is a continuation of application Ser. No. 503,085 filed Sept. 4, 1974, now abandoned.

BACKGROUND OF THE INVENTION (a) Field of the Invention

This invention relates to photosensitive materials for use in electrophotography which comprise a conductive support coated with a photoconductive layer and a protective layer wherein said protective layer formed on said photoconductive layer comprises specifically selected components which improve the light-decay property, mechanical strength and image formability of said photosensitive materials.

(b) Description of the Prior Art

Photosensitive materials for use in electrophotography have benerally been provided by forming a photocontive layer consisting of an inorganic semi-conductor or an organic semi-conductor on a conductive support. To form an electrostatic latent image on such photosensitive materials, the so-called Carlson's process has been employed. This process comprises charging of the photoconductive layer side of the photosensitive material and image-like exposure. However, photosensitive materials of this type lack mechanical strength in the photoconductive layer and break easily when used repeatedly. To avoid this defect, there have hitherto been proposed a variety of photosensitive materials aimed at improving durability by providing a transparent protective film of resin formed on the photoconductive layer. Such photosensitive materials are disclosed in Japanese Patent Publication No. 23910/1967, Japanese Patent Publication No. 19748/1967, Japanese Patent Publication No. 24748/1968, Japanese Patent Publication No. 2965/1974, Japanese Patent Publication No. 15446/1963, Japanese Patent Publication No. 3713/1971, Laid-open Application No. 22036/1973 and U.S. Pat. No. 3,140,174. These proposed photosensitive materials are defective in that the provision of a protective layer has caused a deterioration of the light-decay property (sensitivity) inherent in the photoconductive layer, and a tendency to give rise to blurred images. Moreover, their mechanical strength is unsatisfactory. These deficiencies have been considered attributable to the insufficiency of the insulating property or the physical properties of the resin employed for the protective layer.

The present inventors have found that, by forming said protective layer utilizing specifically selected resins, or selected resins together with a silane-coupling agent, not only can the mechanical strength of the protective layer be improved, but also the adhesive property thereof to the photoconductive layer can be enhanced. Moreover, in neither case is there an insulating property of the protective layer, and in both cases the aforesaid defects of the conventional photosensitive materials are substantially eliminated.

SUMMARY OF THE INVENTION

The principal object of the present invention is to provide photosensitive materials for use in electrophotography which are superior in durability to conventional photosensitive materials.

Another object of the present invention is to provide photosensitive materials which do not cause deterioration of the light-decay property inherent in the photoconductive layer despite the provision of a protective layer and can produce an image free of any disorder or blur.

More specifically, the present invention provides photosensitive materials for use in electrophotography which comprises, as shown in FIG. 1 of the accompanying drawings, a photoconductive layer 2, a protective layer 1, and a conductive support 3, wherein said protective layer is composed of either (1) a member selected from the group of resins consisting of polyvinyl butyral, polyvinyl acetate, acrylic or derivative resins thereof, copolymers of styrene and maleic anhydride or alkyl esters thereof, copolymers of vinyl acetate or derivatives thereof (such as alkyl derivatives) and vinyl pyrrolidone, copolymers of butyl vinyl ether and maleic anhydride or alkyl monoesters thereof, polyamides, polyvinyl pyrrolidones, polyvinyl alcohols, polyvinyl acetals, cellulose and shellac, or composed mainly of (2) a resin selected from the above-mentioned resins or other resins together with a silane-coupling agent. By applying an adhesive to the interspaces of said support, photoconductive layer and protective layer, the strata can be strengthened.

Conventional materials may be used to form the photoconductive layer in the present invention. These include plates or cylinders made of aluminum, copper, stainless steel and the like, paper or plastic film deposited with such metals through vacuum evaporation, conductive glass, etc.

Typical photoconductive substances which may be employed in the photoconductive layer in the present invention include inorganic semi-conductors such as zinc oxide, titanium oxide, cadmium sulfide, and film-forming organic semi-conductors such as poly-N-vinyl carbazole, poly-N-vinyl-3,6-dibromocarbazole, pyrene-formaldehyde resins, polyvinyl dibenzothiophene and polyvinyl anthracene. Inorganic semi-conductors such as selenium which can be used independently, and CdS and ZnO which are used together with resinous binders can be utilized. These binders include, for example, acrylic resins, silicone resins, alkyd resins, epoxide resins, styrene-butadiene resins and melamine resins. Sensitizers, coloring materials, or electron acceptors such as Rose Bengal, fluorescene, Methylene Blue, benzopyrylium, 2,4,7-trinitrofluorenone may be employed in the conventional manner. Selenium may be doped with telurium.

In order to prepare the photosensitive materials for use in electrophotography according to the present invention, a photoconductive layer is first formed on a conductive support and dried in the conventional manner. The protective layer is formed from a solution of the aforesaid specific resin or a resin and a silane-coupling agent by coating with the knife coater, blade or the like or impregnating and drying thereafter. Typically, the thickness of the protective layer is from about 0.1–30$\mu$, preferably 0.1–25$\mu$. The solvent utilized in forming the protective layer should not dissolve or otherwise affect the photoconductive layer. Solvents having an SP value (solubility parameter value) of more than 11 or less than 8 are particularly useful. These include, for example, alcohols such as methanol and ethanol, ethylene glycol, water, carbon tetrachloride, n-hexane, and the like.

All of the aforesaid specific resins for use in the protective layers of the present invention have sufficient insulating ability and are superior in such physical properties as film-formability, adhesive strength, so that they do not adversely affect the electrophotographic properties of the photoconductive layer. Moreover, they are readily available commercially or can be prepared utilizing known methods of synthesis.

The protective layer may also contain such additives as adhesives, cross-linking agents (including those which also function as adhesives), curing catalysts and/or wetting agents to the extent of up to 50% by weight based on the total weight of the protective layer in order to improve abrasion resistance, resistance to wetting and adhesive strength.

Typical adhesives which can be employed for this purpose include vinyl resins as polyvinyl butyral, polyvinyl alcohol, polyvinyl chloride, polyvinyl acetate, acrylic resins, epoxide resins, urethane resins and the like.

Useful cross-linking agents include, for example, aminotriazines, urea resins, epoxide resins, urethane resins, and the like. Amino triazines are especially effective. Typical aminotriazines which may be mentioned by way of example include butyrated melamine, hexamethoxymethylol melamine, acetoquanamine, benzoquanamine, formquanamine, N-(t-butyl)melamine, N-(t-octyl)melamine, 2-phenyl-P-oxy-4,6 diamino-1,3,5-triazine, 6-methyl-2,4-diamino-1,3,5-triazine, 2,4,6-trihydrazine-1,3,5-triazine, N,N-dialkyl melamine and the like.

Curing catalysts which may be utilized include acid catalysts such as sulfuric acid, paratoluene sulfonic acid, 1-naphthalene sulfonic acid and the like. Paratoluene sulfonic acid is most effective. In addition to the above, there are potassium persulfate, ammonium persulfate, hydrogen peroxide solution and the like.

Various commercial silicone oils are applicable as wetting agents.

Cross-linking agents which concurrently act as adhesives include silane-coupling agents which can effect adhesion between the photoconductive layer and the protective layer through chemical reaction and form a firm coating film. Such silane-coupling agents are readily available on the market. They include, for instance, vinyl chlorosilane, vinyl triethoxysilane, vinyl trimethoxysilane, vinyltris(β-methoxyethoxy)silane, γ-methacryloxypropyl trimethoxysilane, γ-methacryloxypropyl tris(β-methoxyethoxy)silane, β-(3,4-epoxycyclohexyl)ethyl trimethoxysilane, γ-glydicoxypropyl trimethoxysilane, vinyl triacetoxysilane, γ-mercaptopropyl trimethoxysilane, γ-aminopropyl triethoxysilane, N-β-(aminoethyl)-γ-aminopropyltrimethoxysilane, N-β-(aminoethyl)-γ-aminopropyl methyl dimethoxysilane, N,N-bis(β-hydroxyethyl)-γ-aminopropyl triethoxysilane, γ-chloropropyl trimethoxysilane and the like.

Because of reaction between various functional groups such as epoxide groups and carboxyl or hydroxyl groups, melamine and carboxyl group, present in the above-mentioned adhesive, cross-linking agents, curing agents, a three-dimensional structure is formed so that the abrasion resistance, resistance to wetting and adhesive strength of the protective layer is remarkably improved.

The silane-coupling agents contain two or more reactive groups of different reactivity in the same molecule. One is a reactive group capable of effecting film coupling by chemically bonding with inorganic matter (e.g., methoxyl group and silanol group) and the other is a reactive group capable of effecting chemical bonding with organic matter (e.g., vinyl group, epoxide group, methacryl group and amino group). As a result, the silane-coupling agent not only enhances the binding property of organic materials but also functions as a mediator between the organic materials and inorganic materials, so that it renders it possible to mix those inorganic materials which will increase the mechanical strength and those organic materials which will result in a three-dimensional structure in the protective layer of the present invention. Useful inorganic materials include, for instance, quartz sand, glass fiber, amorphous silica, crystal silica and metal oxides such as $Al_2O_3$, ZnO, MgO. Useful organic materials include, for instance, cross-linking agents or adhesives such as the aforesaid epoxide resins, polyamide resins, urea resins, urethane resins and amino triazines.

When a resin is used together with a silane-coupling agent, the quantity of said agent utilized in the protective layer is from about 0.01 wt% to 10 wt.%. Increased quantities of silane-coupling agents tend to reduce the cohesive strength of the protective layer. The preferred quantity is from 0.1 wt.% to 0.24 wt.%.

It is not essential to employ a silane-coupling agent in the protective layer, as has been suggested above. It is, however, preferred to do so. With conventional resins such as polyamides, polyvinyl pyrrolidones, polyvinyl alcohols, polyvinyl acetals, and cellulose, the silane-coupling agent is indispensable.

In order to form an electrostatic latent image on the photosensitive material prepared as above, the Carlson's process or modifications thereof such as the processes disclosed in Japanese Patent Publication No. 2965/1973 and Japanese Patent Publication No. 37,959/1970 are applicable. In other words, it suffices to apply either a process comprising, in order, subjecting the protective layer side to a primary charging, charging elect ricity having a polarity opposite to that of said primary charging or applying AC corona discharge simultaneously with the image-like exposure, and subsequently effecting an overall exposure, an occasion demands, or a process comprising subjecting the protective layer side to a primary charging, applying an overall exposure simultaneously with or immediately after said primary charging, subsequently charging electricity having a polarity opposite to that of said primary charging, and thereafter effecting the image-like exposure to thereby form an electrostatic latent image, followed by development, transfer and fixing according to the conventional methods.

Inasmuch as the photosensitive material for use in electrophotography according to the present invention is provided with a protective layer, it can be used repeatedly. Moreover, it is free of deterioration of the electrophotographic properties of photoconductive layer thereof despite the provision of a protective layer thereon.

The following nonlimiting examples are given by way of illustration only.

DESCRIPTION OF THE PREFERRED EMBODIMENTS

EXAMPLE 1

| | |
|---|---|
| Poly-N-vinyl carbazole | 2.0 g |
| 2,4,7-Trinitrofluorenone | 3.3 g |
| Polyester Adhesive 49,000 (the manufacture of DuPont Co.) | 0.472 g |
| Silicone Oil Ak-1,000 (the manufacture of Worker Chemical GMBH) | 0.014 g |
| Tetrahydrofuran | 41.7 g |

A solution having the above composition was coated on a polyester film deposited with aluminum through vacuum evaporation by the use of a doctor blade and was dried at a temperature of 60° C. for 10 minutes and at a temperature of 100° C. for 2 minutes in succession, whereby a 20μ-thick organic photoconductive layer was formed. Next, a 10 wt.% methanol solution of butyral resin (a manufacture of SEKISUI KAGAKU K.K.; trade name: S-LEC BM-2) was coated on the thus prepared photoconductive layer to the extent of 10–20μ in dry thickness, whereby a transparent protective layer was formed. The resulting photosensitive material was so superior in flexibility that it could be easily fastened around a cylinder.

Figure 1:
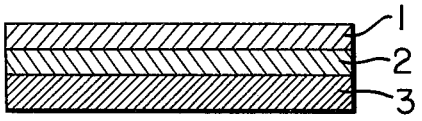
FIG. 1 is a cross-sectional view of a photosensitive material according to the present invention, wherein 1 denotes the protective layer, 2 denotes the photoconductive layer and 3 denotes the conductive support.
Figure 2:
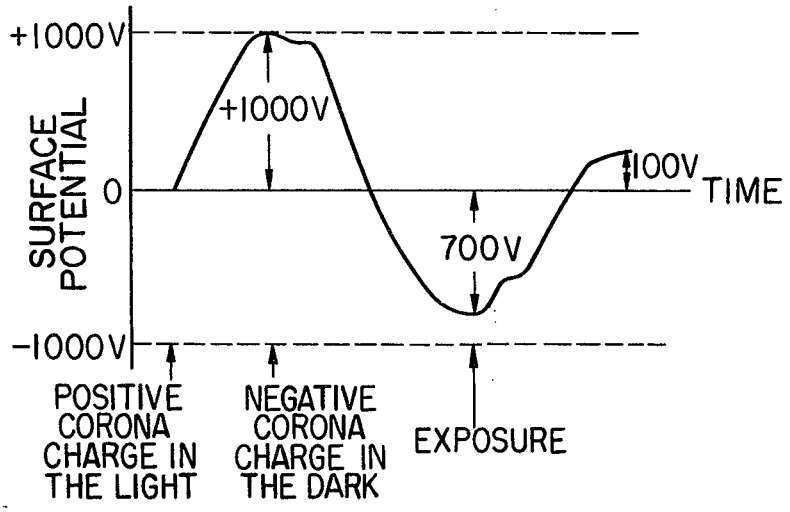
FIGS. 2 and 3 are respectively a curve showing the surface potential difference between the exposed area and the non-exposed area of the photosensitive material according to the present invention used in Example 1 and Example 3, respectively.
Figure 3:
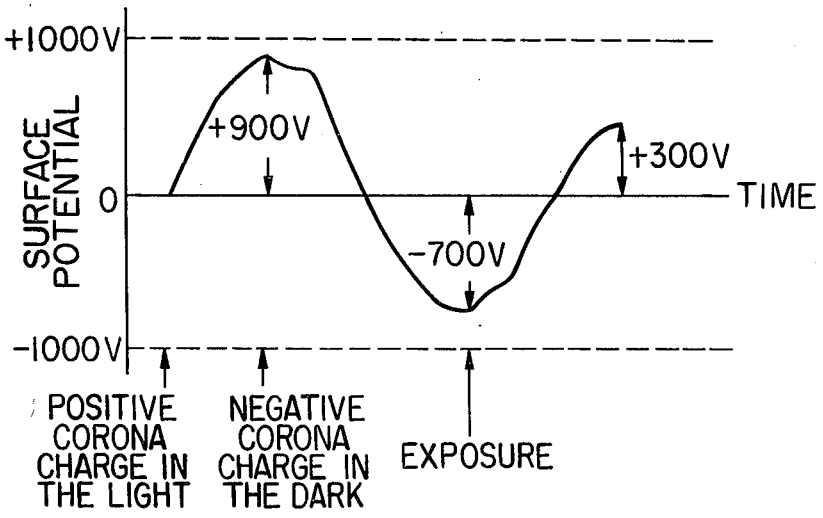

The thus prepared photosensitive material was charged with positive electricity by corona discharge of 6.5 KV and was subjected to overall exposure simultaneously with or immediately after said charging. The surface potential at this time was +1000 V. Subsequently, by charging negative electricity by corona discharge of 5.3 KV in the dark (the surface potential at this time was −700 V) and subjecting to image-like exposure under the condition of 18 lux.sec, an electrostatic latent image was formed on the photosensitive material. The surface potential at this time was +100 V, and the potential difference between the non-exposed area and the exposed area was 800 V as shown in FIG. 2 of the accompanying drawings.

Next, when the image produced through dry-developing process or wet-developing process according to the known methods was electrostatically transferred to a slick paper and fixed, there was obtained a positive image in which the background was free of stains and faithful to the original image. Even after producing 5,000 copies by repeating the above procedures, there was observed no deterioration of sensitivity or image.

EXAMPLE 2

By coating a solution having the same composition and under the same condition of coating as in Example 1, a 2μ-thick organic photoconductive layer was formed on a polyester film deposited with aluminum through vacuum evaporation. Next, a 10 wt.% methanol solution of polyvinyl acetate resin (a manufacture of Daicel Co.; trade name: SEVIAN A-001) was coated on the thus prepared photoconductive layer to the extent of 12–15μ in dry thickness by the use of a doctor blade, whereby a transparent protective layer was formed. The resulting photosensitive material was so superior in flexibility that it could be easily fastened round on a cylinder.

This photosensitive material was then charged with positive electricity by corona discharge of 6.5 KV and was subjected to overall exposure simultaneously with or immediately after said electrification. The surface potential at this time was +800 V. Subsequently, by charging negative electricity by corona discharge of 4.7 KV in the dark (the surface potential at this time was −500 V) and then subjecting to image-like exposure under the condition of 18 lux.sec, an electrostatic latent image was formed on the photosensitive material. The surface potential at this time was +200 V, and the potential difference between the non-exposed area and the exposed area was 700 V as shown in FIG. 2. Next, when a positive image was formed in the same way as in Example 1 and the test copying was repeated, the result was the same as in Example 1.

EXAMPLE 3

By coating a solution having the same composition and under the same condition of coating as in Example 1, a 20μ-thick organic photoconductive layer was formed on a polyester film deposited with aluminum through vacuum evaporation. Next, a 10 wt.% methanol solution of acryl polyol (a manufacture of SOKEN KAGAKU K.K. having hydroxyl group value of 30; trade name: THERMOLAC U-230A) was coated on the foregoing photoconductive layer to the extent of 12–16μ in dry thickness by the use of a doctor blade, wherety a transparent protective layer was formed. The resulting photosensitive material was so superior in flexibility that it could be easily fastened round on a cylinder.

The thus prepared photosensitive material was then charged with positive electricity by corona discharge of 6.5 KV and was subjected to overall exposure simultaneously with or immediately after said electrification. The surface potential at this time was +900 V. Subsequently, by charging negative electricity by corona discharge of 4.7 KV in the dark (the surface potential on this occasion was −700 V) and then subjecting to image-like exposure under the condition of 18 lux.sec, an electrostatic latent image was formed on the photosensitive material. The surface potential between the non-exposed area and the exposed area was 1,000 V as shown.

Next, when a positive image was formed in the same way as in Example 1 and the test copying was repeated, the result was equal to that in Example 1.

EXAMPLE 4

By applying the same procedure as in Example 3, a 20μ-thick organic photoconductive layer and a 10–15μ-thick transparent protective layer were formed on a polyester film deposited with aluminum through vacuum evaporation.

The thus prepared photosensitive material was then charged with positive electricity by corona discharge of 6.5 KV and was subjected to overall exposure simultaneously with or immediately after said electrification. The surface potential at this time was +750 V. Subsequently, by charging negative electricity by corona discharge of 5.3 V in the dark (the surface potential at this time was −800 V) and then subjecting to image-like exposure under the condition of 18 lux.sec, an electrostatic latent image was formed on the photosensitive material. The surface potential of the exposed area at this time was +100 V and the potential difference between the non-exposed area and the exposed area was 900 V. Next, when a positive image was formed in the same way as in Example 1 and the test copying was repeated, the result was equal to that in Example 1.

| | |
|---|---|
| Poly-N-vinyl carbazole | 2.0 g |
| 2,4,7-Trinitrofluorenone | 3.3 g |
| Polyester Adhesive 49,000 (the manufacture of DuPont Co.) | 0.472 g |
| Silicone Oil Ak-1,000 (the manufacture of Worker Chemical GMBH) | 0.014 g |
| Tetrahydrofuran | 41.7 g |

A solution having the above composition was coated on a polyester film deposited with aluminum through vacuum evaporation by the use of a doctor blade and was dried at a temperature of 60° C. for 10 minutes and at a temperature of 100° C. for 2 minutes in succession, whereby a 20μ-thick organic photoconductive layer was formed. Meanwhile, upon putting 300 ml of benzene, 10.4 g (0.1 mole) of styrene, 9.8 g (0.1 mole) of maleic anhydride and 0.1 g of benzoyl peroxide in a 4-nozzled flask having the capacity of 500 ml as equipped with the agitator, thermometer, reflux cooling pipe and nitrogen-inducing pipe, agitation was carried out at room temperature until a transparent solution was obtained. While thus agitating, the mixture was heated to boil in water bath, whereby copolymer was gradually formed. After one hour's reaction, the mixture was cooled and the solid polymer was separated therefrom by filtration, whereby 200 g of white powder were yielded. When 10 g of the thus obtained copolymer were taken into a 4-nozzled flask having the capacity of 300 ml, 90 g of methyl alcohol were added thereto, and the resulting mixture was refluxed on water bath for 5 hours, said copolymer dissolved in methyl alcohol to produce a transparent methyl ester compound.

A 5–10 wt.% methanol solution of the thus obtained methyl ester of copolymer of styrene and maleic anhydride was coated on the aforesaid photoconductive layer to the extent of 0.1–15μ in dry thickness, whereby two varieties of photosensitive materials having a 2.1μ-thick protective layer and a 13.4μ-thick protective layer, respectively, were prepared. The thus prepared photosensitive materials were so superior in flexibility that they could be easily fastened on a cylinder.

These photosensitive materials were then charged with negative electricity by corona discharge of 6.0 KV, exposed to the light of white tungsten lamp of 20 luxes, and subjected to measurement for determining the amount of exposure E ½ (lux.sec) required for decay of the surface potential to ½, the amount of exposure E 1/5 (lux.sec) required for decay of the surface potential to 1/5 and the amount of exposure E 1/10 (lux.sec) required for decay of the surface potential to 1/10, after applying the light. And, the values obtained from this measurement, which represent the sensitivity of the photosensitive materials, were compared with the counterpart of a photosensitive material having no protective layer. The result was as shown in the following Table 1.

Table 1

| photosensitive layer | light-decay property | | |
|---|---|---|---|
| | E 1/2 | E 1/5 | E 1/10 |
| none | 4.6 | 12.0 | 20.6 |
| 2.1 μ-thick layer | 4.6 | 12.1 | 20.5 |
| 13.4 μ-thick layer | 4.6 | 12.0 | 22.3 |

As is evident from the showing in this table, the sensitivity of the photosensitive materials according to the present invention was practically equal to that of the photosensitive material having no protective layer.

Next, when the image produced through the known dry-developing process or wet-developing process was electrostatically transferred to a slick paper and fixed, there was obtained a positive image having a background free of stains and faithful to the original image. Even after producing 30,000 copies by repeating the foregoing procedures, there was observed no deterioration of the sensitivity nor occurrence of any disorder of image. Meanwhile, as for the photosensitive material having no protective layer, when the image test was conducted in the same way as above, it was observed that the sensitivity deteriorated, the background became stained, and the image became disordered when only 5,000 copies were produced.

EXAMPLE 6.

| | |
|---|---|
| poly-N-vinyl carbazole | 2.0 g |
| 2,4,7-trinitrofluorenone | 3.3 g |
| polycarbonate | 0.472 g |
| Silicone Oil Ak-1,000 (the manufacture of Worker Chemical GMBH) | 0.014 g |
| tetrahydrofuran | 41.7 g |

A solution having the above composition was coated on a polyester film deposited with aluminum through vacuum evaporation by the use of a doctor blade and was dried at a temperature of 60° C. for 10 minutes and at a temperature of 100° C. for 2 minutes in succession, whereby an 18μ-thick organic photoconductive layer was formed.

Meanwhile, by putting 10 g of the styrene-maleic anhydride copolymer obtained in Example 5 in a 4-nozzled flask having the capacity of 300 ml, adding 90 g of ethyl alcohol thereto and refluxing the resulting mixture on water bath for 5 hours, said copolymer was dissolved in ethyl alcohol and a transparent ester compound was prepared.

A 5–10 wt.% methanol solution of the thus prepared ethyl ester of styrene-maleic anhydride copolymer was coated on the foregoing photoconductive layer to the extent of 0.1–20μ in dry thickness, whereby two varieties of photosensitive materials having a 5.4μ-thick protective layer and an 18.2μ-thick protective layer, respectively, were prepared. These photosensitive materials were so superior in flexibility that they could be easily fastened on a cylinder. When the light-decay property of these photosensitive materials was measured in the same way as in Example 5, the results were shown in the following Table 2.

Table 2

| photosensitive layer | light-decay property | | |
|---|---|---|---|
| | E 1/12 | E 1/5 | E 1/10 |
| none | 4.8 | 12.5 | 21.4 |
| 5.4 μ-thick layer | 4.8 | 12.4 | 21.6 |
| 18.2 μ-thick layer | 4.8 | 13.0 | 22.0 |

As is evident from the showing in this table, the sensitivity of the photosensitive materials according to the present invention was practically equal to that of the photosensitive material having no protective layer.

Next, when the image test of the present photosensitive materials was conducted in the same way as in Example 5, it was possible to obtain a positive image having a background free of stains and being faithful to the original image. There was no deterioration of iamge even after producing 25,00 copies.

EXAMPLE 7

By coating a solution having the same composition and under the same condition of coating as in Example 5, a 20μ-thick organic photoconductive layer was formed on a polyester film deposited with aluminum through vacuum evaporation. Meanwhile, by putting 10 g of the styrene-maleic anhydride copolymer obtained in Example 5 in a 4-nozzled flask having the capacity of 300 ml, adding 90 g of isopropyl alcohol thereto and refluxing the mixture on oil bath for 5 hours, said copolymer was dissolved in isopropyl alcohol and a transparent isopropyl ester compound was prepared.

A 5–10 wt.% methanol solution of the thus prepared isopropyl ester of styrene-maleic anhydride copolymer was coated on the foregoing photoconductive layer to the extent of 0.1–20μ in dry thickness, whereby two varieties of photosensitive materials having a 2.5μ-thick protective layer and a 16.7μ-thick protective layer, respectively, were prepared. These photosensitive materials were so superior in flexibility that they could be easily fastened on a cylinder. When the light-decay property of these photosensitive materials was measured in the same way as in Example 5, the results were as shown in the following Table 3.

Table 3

| protective layer | light-decay property | | |
|---|---|---|---|
| | E 1/2 | E 1/5 | E 1/10 |
| none | 4.6 | 12.0 | 20.6 |
| 2.5 μ-thick layer | 4.6 | 12.0 | 21.3 |
| 16.7 μ-thick layer | 4.6 | 11.9 | 21.9 |

As is evident from the showing in this table, the sensitivity of the photosensitive materials according to the present invention was practically equal to that of the photosensitive material having no protective layer.

Next, when the image test of the present photosensitive materials was conducted in the same way as in Example 5, it was possible to obtain a positive image having a background free of stains and being faithful to the original image. There was no deterioration of image even after the production of 30,000 copies.

EXAMPLE 8

By depositing amorphous selenium containing 10% of tellurium to the extent of 50μ thickness through vacuum evaporation on a polyester film deposited with aluminum through vacuum evaporation, an organic photoconductive layer was formed. Next, a 5–10 wt.% methanol solution of methyl ester of styrene-maleic anhydride copolymer obtained in Example 5 was coated on the foregoing photoconductive layer to the extent of 0.1–30μ in dry thickness, whereby two varieties of photosensitive materials having a 3.3μ-thick protective layer and a 25.6μ-thick protective layer, respectively, were prepared. When the light-decay property of these photosensitive materials was measured in the same way as in Example 5, the result was as shown in the following Table 4.

Table 4

| protective layer | light-decay property | | |
|---|---|---|---|
| | E 1/2 | E 1/5 | E 1/10 |
| none | 2.0 | 3.8 | 7.0 |

Table 4-continued

| protective layer | light-decay property | | |
|---|---|---|---|
| | E 1/2 | E 1/5 | E 1/10 |
| 3.3 μ-thick layer | 2.0 | 3.6 | 7.1 |
| 25.6 μ-thick layer | 2.0 | 3.6 | 7.1 |

As is evident from the showing in this table, the sensitivity of the photosensitive materials according to the present invention was practically equal to that of the photosensitive material having no protective layer.

Next, when the image test of the present photosensitive materials was conducted in the same way as in Example 5, it was possible to obtain a positive image having a background free of stains and being faithful to the original image. There was no deterioration of image even after producing 28,000 copies.

EXAMPLE 9

| | |
|---|---|
| Poly-N-vinyl carbazole | 2.0 g |
| 2,4,7-Trinitrofluorenone | 3.3 g |
| Polyester Adhesive 49,000 (the manufacture of DuPont Co.) | 0.472 g |
| Silicone Oil Ak-1,000 (the manufacture of Worker Chemical GMBH) | 0.014 g |
| Tetrahydrofuran | 41.7 g |

A solution having the above composition was coated on a polyester film deposited with aluminum through vacuum evaporation by the use of a doctor blade and was dried at a temperature of 60° C. for 10 minutes and at a temperature of 100° C. for 2 minutes in succession, whereby a 20μ-thick organic photoconductive layer was formed.

Meanwhile, by dissolving 10 g of ethyl acrylate-acrylic acid copolymer (molar ratio = 90:10) in 90 g of isopropanol and then adding 3.5 g of hexamethoxymethylol melamine, 0.35 g of p-toluene sulfonic acid and 0.5 g of β(3,4-epoxycyclohexyl)ethyl trimethoxy silane thereto, an overcoat solution was prepared. Further, after adjusting the concentration (in terms of said copolymer) of this solution to be in the range of 5–10%, by coating the thus adjusted solution on the foregoing photoconductive layer, two varieties of photosensitive materials having a 1.5μ-thick protective layer and a 6.5μ-thick protective layer, respectively, were prepared. The thus prepared photosensitive materials were so superior in flexibility that they could be easily fastened on a cylinder.

These photosensitive materials were charged with negative electricity by corona discharge of 6.0 KV, exposed to the light of white tungsten lamp of 20 luxes, and subjected to measurement for determining the amount of exposure E ½ (lux.sec) required for decay of the surface potential to ½, the amount of exposure E 1/5 (lux.sec) required for decay of the surface potential to 1/5 and the amount of exposure E 1/10 (lux.sec) required for decay of the surface potential to 1/10, after applying the light. And, the values obtained from this measurement, which represent the sensitivity of the photosensitive materials, were compared with the counterpart of a photosensitive material having no protective layer. The results are shown in the following Table 5.

Table 5

| protective layer | light-decay property | | |
|---|---|---|---|
| | E 1/2 | E 1/5 | E 1/10 |
| none | 4.6 | 12.0 | 20.6 |
| 1.5 μ-thick layer | 4.6 | 12.1 | 20.8 |
| 6.5 μ-thick layer | 4.6 | 12.1 | 21.0 |

As is evident from the showing in this table, the sensitivity of the photosensitive materials according to the present invention was practically equal to that of the photosensitive material having no protective layer.

Next, when the image produced through the known dry-developing process or wet-developing process was electrostatically transferred to a slick paper and fixed, there was obtained a positive image free of background stains and being faithful to the original image. Even after producing 30,000 copies by repeating the foregoing procedures, there was observed no deterioration of the sensitivity nor occurrence of any disorder of image. However, with the photosensitive material having no protective layer, when the image test was conducted in the same way as above, it was observed that the sensitivity deteriorated, the background became stained and the image became disordered when only 5,000 copies were produced. Further in the case of the photosensitive materials having the protective layer, it was possible to obtain a copied image free of disorder and faithful to the original image in the atmosphere of 15° C. in temperature and 20% RH as well as 30° C. in temperature and 80% RH.

EXAMPLE 10.

| | |
|---|---|
| Poly-N-vinyl carbazole | 2.0 g |
| 2,4,7-Trinitrofluorenone | 3.3 g |
| Polyester Adhesive 49,000 (the manufacture of DuPont Co.) | 0.472 g |
| Silicone Oil Ak-1,000 (the manufacture of Worker Chemical GMBH) | 0.014 g |
| Tetrahydrofuran | 41.7 g |

By coating a solution having the above composition in the same way as in Example 9, a 20μ-thick organic photoconductive layer was formed. Next, by adding 5 g of hexamethoxymethylol malamine, 0.5 g of p-toluene sulfonic acid, 0.5 g of γ-aminopropyl triethoxysilane and 0.05 g of Silicone Oil KF-96 (the manufacture of SHINETSU KAGAKU K.K.) to a 10 wt.% ethanol solution of poly(butyl vinyl ether/maleic anhydride) ethyl ester (Gantlets ES-225, the manufacture of GAF Co.), an overcoat solution was prepared. Further, after adjusting the concentration (in terms of copolymer) of this solution to be in the range of 5–10%, by coating the thus adjusted solution on the foregoing photoconductive layer, two varieties of photosensitive materials having a 2.2μ-thick protective layer and an 8.3μ-thick protective layer, respectively, were prepared. The thus prepared photosensitive materials were so superior in flexibility that they could be easily fastened on a cylinder.

When the light-decay property of these photosensitive materials was measured in the same way as in Example 9, the results were as shown in the following Table 6.

Table 6

| protective layer | light-decay property | | |
|---|---|---|---|
| | E 1/2 | E 1/5 | E 1/10 |
| none | 4.6 | 12.0 | 20.6 |
| 2.2 μ-thick layer | 4.6 | 12.2 | 20.6 |
| 8.3 μ-thick layer | 4.6 | 12.5 | 21.5 |

As is evident from the showing in this table, the sensitivity of the photosensitive materials according to the present invention was practically equal to that of the photosensitive material having no protective layer.

Next, when the image test was conducted in the same way as in Example 9, it was possible to obtain a positive image free of background stains and being faithful to the original image. There was no deterioration of image even after producing 30,000 copies. Further, when subjected to the test of wet-proof property thereof in the same way as in Example 9, copies faithful to the original image were produced.

EXAMPLE 11.

| | |
|---|---|
| poly-N-vinyl carbazole | 2.0 g |
| 2,4,7-trinitrofluorenone | 3.3 g |
| polycarbonate | 0.472 g |
| Silicone Oil Ak-1,000 (the manufacture of Worker Chemical GMBH) | 0.014 g |
| tetrahydrofuran | 41.7 g |

A solution having the above composition was coated on a polyester film deposited with aluminum through vacuum evaporation by the use of a doctor blade and was dried at a temperature of 60° C. for 10 minutes and at a temperature of 100° C. for 2 minutes in succession, whereby an 18μ-thick organic photoconductive layer was formed.

Meanwhile, by adding 5 g of butyrated melamine, 0.5 g of p-toluene sulfonic acid, 0.5 g of γ-glycidoxypropyl trimethoxysilane and 0.5 g of silica (AEROSIL 200, the manufacture of NIPPON AEROSIL K.K.) to a 10 wt.% methanol solution of polyvinyl acetate (S-NYL D-18, the manufacture of SEKISUI KAGAKU K.K.), an overcoat solution was prepared. Subsequently, by coating the thus prepared overcoat solution on the foregoing photoconductive layer, a photosensitive material having a 22.5μ-thick protective layer was prepared. This photosensitive material was so superior in flexibility that it could be easily fastened on a cylinder.

Next, utilizing this photosensitive material, a photosensitive latent image was formed according to the method disclosed in the specification for Japanese Patent Publication No. 2965/1973. To be precise, the photosensitive material was first charged with positive electricity by corona discharge of 6.5 KV, and was subjected to overall exposure simultaneously with or immediately after said charging. The surface potential at this time was +1020 V. Thereafter, the material was charged with negative electricity by corona discharge of 4.7 KV in the dark (the surface potential at this time was −850 V) and then subjected to image-like exposure under the condition of 18 lux.sec, whereby an electrostatic latent image was formed thereon. The surface potential of the exposed area at this time was +80 V, and the potential difference between the non-exposed area and the exposed area was 930V.

Next, after developing said latent image through the dry process, the resulting image was electrostatically transferred onto a slick paper and fixed, whereby there was obtained a positive image having background free of stains and faithful to the original image.

When the present photosensitive material was utilized for producing 30,000 copies by repeating the foregoing procedure, no deterioration of sensitivity nor disorder of image was observed. Further, when subjected to the test of wet-proof property thereof in the same way as in Example 9, it produced copies faithful to the original image.

EXAMPLE 12

By depositing amorphous selenium containing 10% of tellurium to the extent of 50μ in thickness through vacuum evaporation on a polyester film deposited with aluminum through vacuum evaporation, an organic photoconductive layer was formed. Next, by adding 5 g of butyrated melamine, 0.5 g of p-toluene sulfonic acid, 0.5 g of N-β(aminoethyl)γ-aminopropyl trimethoxysilane and 0.05 g of Silicone Oil KF-96 (the manufacture of SHINETSU KAGAK K.K.) to a 5–10 wt.% methanol solution of methyl ester of styrene-maleic anhydride copolymer, an overcoat solution was prepared. And, upon adjusting this solution to have a concentration (in terms of said copolymer) in the range of 5–10%, the thus adjusted solution was coated on the foregoing photoconductive layer to the extent of 0.1–30μ in dry thickness, whereby two varieties of photosensitive materials having a 3.6μ-thick protective layer and a 24.1μ-thick protective layer, respectively, were prepared.

When the light-decay property of these photosensitive materials was measured in the same way as in Example 9, the results were as shown in the following Table 7.

Table 7

| protective layer | light-decay property | | |
|---|---|---|---|
| | E 1/2 | E 1/5 | E 1/10 |
| none | 2.0 | 3.8 | 7.0 |
| 3.6 μ-thick layer | 2.0 | 3.8 | 7.2 |
| 24.1 μ-thick layer | 2.0 | 4.0 | 7.8 |

As is evident from the showing in this table, the sensitivity of the photosensitive materials according to the present invention was practically equal to that of the photosensitive material having no protective layer.

Next, when the image test was conducted in the same way as in Example 9, it was possible to obtain a positive image having no background stains and faithful to the original image. There was no deterioration of image even after producing 30,000 copies. Further, when subjected to the test of wet-proof property thereof in the same way as in Example 9, they produced copies faithful to the original image.

EXAMPLE 13

| | |
|---|---|
| Poly-N-vinyl carbazole | 2.0 g |
| 2,4,7-Trinitrofluorenone | 3.3 g |
| Polyester Adhesive 49,000 (the manufacture of DuPont Co.) | 0.472 g |
| Silicone Oil Ak-1,000 (the manufacture of Worker Chemical GMBH) | 0.014 g |
| Tetrahydrofuran | 41.7 g |

A solution having the above composition was coated on a polyester film deposited with aluminum through vacuum evaporation by the use of a doctor blade and was dried at a temperature of 60° C. for 10 minutes and at a temperature of 100° C. for 2 minutes in succession, whereby a 20μ-thick organic photoconductive layer was formed. Subsequently, by coating a 5–10 wt.% methanol solution of shellac on the foregoing photoconductive layer to the extent of 0.1–10μ in dry thickness, two varieties of photosensitive materials having a 2.0μ-thick protective layer and a 7.8μ-thick protective layer, respectively, were prepared. The thus prepared photosensitive materials were so superior in flexibility that they could be readily fastened on a cylinder.

These photosensitive materials were charged with negative electricity by corona discharge of 6.0 KV, exposed to the light of white tungsten lamp of 20 luxes, and subjected to measurement for determining the amount of exposure E ½ (lux.sec) required for decay of the surface potential to ½, the amount of exposure E 1/5 (lux.sec) required for decay of the surface potential to 1/5 and the amount of exposure E 1/10 (lux.sec) required for decay of the surface potential to 1/10, after applying the light. The values obtained from this measurement, which represent the sensitivity of the photosensitive materials, were compared with the counterpart of a photosensitive material having no protective layer. The results are shown in the following Table 8.

Table 8

| protective layer | light-decay property | | |
|---|---|---|---|
| | E 1/2 | E 1/5 | E 1/10 |
| none | 4.6 | 12.0 | 20.6 |
| 2.0 μ-thick layer | 4.7 | 12.0 | 20.9 |
| 7.8 μ-thick layer | 4.7 | 12.8 | 21.0 |

As is evident from the showing in this table, the sensitivity of the photosensitive materials according to the present invention was practically equal to that of a photosensitive material having no protective layer.

Next, when the image obtained through the known dry-developing process or wet-developing process was electrostatically transferred onto a slick paper and fixed, there was obtained a positive image having no background stains and faithful to the original image. Even after producing 30,000 copies by repeating the foregoing procedure, no deterioration of sensitivity nor disorder of image was observed. As for the photosensitive material having no protective layer, when the image test was conducted in the same way as above, it was observed that the sensitivity deteriorated, the background became stained and the image became disordered when only 5,000 copies were produced.

EXAMPLE 14

| | |
|---|---|
| poly-N-vinyl carbazole | 2.0 g |
| 2,4,7-trinitrofluorenone | 3.3 g |
| polycarbonate | 0.472 g |
| Silicone Oil Ak-1,000 (the manufacture of Worker Chemical GMBH) | 0.014 g |
| tetrahydrofuran | 41.7 g |

A solution having the above composition was coated on a polyester film deposited with aluminum through vacuum evaporation by the use of a doctor blade and was dried at a temperature of 60° C. for 10 minutes and at a temperature of 100° for 2 minutes in succession, whereby a 20μ-thick organic photoconductive layer was formed.

Meanwhile, by dissolving 5 g of shellac and 5 g of polyvinyl butyral in 90 g of methyl alcohol, and further adding 3.5 g of hexamethoxymethylol melamine and 0.5 g of β-(3,4-epoxycyclohexyl)ethyl trimethoxysilane, an overcoat solution was prepared. And, after adjusting the concentration (in terms of shellac+polyvinyl butyral) of this solution to be in the range of 5–10%, by coating the thus adjsuted solution on the foregoing photoconductive layer, a photosensitive material having a 13.5μ-thick protective layer was prepared. The thus prepared photosensitive material was so superior in flexibility that it could be easily fastened on a cylinder.

Next, utilizing this photosensitive material, a photosensitive latent image was formed according to the method disclosed in the specification for Japanese Patent Publication No. 2965/1973. To be precise, the photosensitive material was first charged with positive electricity by corona discharge of 6.5 KV, and was subjected to overall exposure simultaneously with or immediately after said electrification. The surface potential at this time was +1100 V. Thereafter, the material was charged with negative electricity by corona discharge of 4.7 KV in the dark (the surface potential at this time was −800 V) and then subjected to image-like exposure under the condition of 18 lux.sec, whereby an electrostatic latent image was formed thereon. The surface potential of the exposed area at this time was +100 V, and the potential difference between the non-exposed area and the exposed area was 900 V.

Next, when this latent image was developed through the known dry-developing process or wet-developing process, electrostatically transferred to a slick paper and fixed, there was obtained a positive image having a background free of stains and faithful to the original image. Even after producing 30,000 copies by repeating the above procedures, this material showed no deterioration of sensitivity nor any disorder of image.

Moreover, such additives as shellac and others can improve the wet-proof property, so that it was possible to obtain a copied image free of disorder and faithful to the original image even in the atmosphere of 15° C. in temperature and 20% RH as well as 30° C. in temperature and 80% RH.

EXAMPLE 15

By depositing amorphous selenium containing 10% of tellurium to the extent of 50μ in thickness through vacuum evaporation on a polyester film deposited with aluminum through vacuum evaporation, an inorganic photoconductive layer was formed. Next, by coating a 5–10 wt. % methanol solution of shellac on this photoconductive layer to the extent of 0.1–30μ in dry thickness, two varieties of photosensitive materials having a 6.5μ-thick protective layer and a 21.6μ-thick protective layer, respectively, were prepared. When the light-decay property of these photosensitive materials was measured in the same way as in Example 13, the results are as shown in the following Table 9.

Table 9

| protective layer | light-decay property | | |
|---|---|---|---|
| | E 1/2 | E 1/5 | E 1/10 |
| none | 2.0 | 3.8 | 7.0 |
| 6.5 μ-thick layer | 2.0 | 3.8 | 7.0 |
| 21.6 μ-thick layer | 2.0 | 3.8 | 8.1 |

As is evident from the showing in this table, the sensitivity of the photosensitive materials according to the present invention was practically equal to that of a photosensitive material having no protective layer.

Next, when the image test was conducted in the same way as in Example 13, it was possible to obtain a positive image free of background stains and faithful to the original image. There was no deterioration even after producing 30,000 copies.

EXAMPLE 16

| | |
|---|---|
| Poly-N-vinyl carbazole | 2.0 g |
| 2,4,7-Trinitrofluorenone | 3.3 g |
| Polyester Adhesive 49,000 (the manufacture of DuPont Co.) | 0.472 g |
| Silicone Oil Ak-1,000 (the manufacture of Worker Chemical GMBH) | 0.014 g |
| Tetrahydrofuran | 41.7 g |

A solution having the above composition was coated on a polyester film deposited with aluminum through vacuum evaporation by the use of a doctor blade and was dried at a temperature of 60° C. for 10 minutes and at a temperature of 100° C. for 2 minutes in succession, whereby a 20μ-thick organic photoconductive layer was formed. Next, by coating a 5–10 wt. % ethanol solution of vinyl acetate-vinyl pyrrolidone copolymer (molar ratio=30:70) (commercial LUVISKOL VA 37-E, the manufacture of BASF) on this photoconductive layer to the extent of 0.1–10μ dry thickness, two varieties of photosensitive materials having a 1.5μ-thick protective layer and 8.6μ-thick protective layer, respectively, were prepared. The thus prepared photosensitive materials were so superior in flexibility that they could be easily fastened on a cylinder.

These photosensitive materials were charged with negative electricity by corona discharge of 6.0 KV, exposed to the light of white tungsten lamp of 20 luxes, and subjected to measurement for determining the amount of exposure E 1/2 (lux.sec) required for decay of the surface potential to 1/2, the amount of exposure E 1/5 (luxsec) required for decay of the surface potential to 1/5 and the amount of exposure E 1/10 (lux.sec) required for decay of the surface potential to 1/10, after applying the light. And, the values obtained from this measurement, which represent the sensitivity of the photosensitive materials, were compared with the counterpart of a photosensitive material having no protective layer. The results are shown in the following Table 10.

Table 10

| protective layer | light-decay property | | |
|---|---|---|---|
| | E 1/2 | E 1/5 | E 1/10 |
| none | 4.6 | 12.0 | 20.6 |
| 1.5 μ-thick layer | 4.6 | 12.0 | 20.7 |
| 8.6 μ-thick layer | 4.6 | 12.5 | 21.4 |

As is evident from the showing in this table, the sensitivity of the photosensitive materials according to the present invention was practically equal to that of a photosensitive material having no protective layer.

Next, when the image obtained through the known dry-developing process or wet-developing process was electrostatically transferred to a slick paper and fixed, there was obtained a positive image having no background stains and faithful to the original image. Even after producing 30,000 copies by repeating the foregoing procedures, the photosensitive materials showed no deterioration of sensitivity nor any disorder of image. Meanwhile, as for the photosensitive material having no protective layer, when the image test was conducted in the same way as above, it was observed that the sensitivity deteriorated, the background became stained and the image became disordered when only 5,000 copies were produced.

EXAMPLE 17

| | |
|---|---|
| poly-N-vinyl carbazole | 2.0 g |
| 2,4,7-trinitrofluorenone | 3.3 g |
| polycarbonate | 0.472 g |
| Silicone Oil Ak-1,000 (the manufacture of Worker Chemical GMBH) | 0.014 g |
| tetrahydrofuran | 41.7 g |

A solution having the above composition was coated on a polyester film deposited with aluminum through vacuum evaporation by the use of a doctor blade and was dried at a temperature of 60° C. for 10 minutes and at a temperature of 100° C. for 2 minutes in succession, whereby an 18μ-thick organic photoconductive layer was formed. Next, by coating a 5–10 wt. % ethanol solution of vinyl acetate-vinyl pyrrolidone copolymer (molar ratio=40:60) (commercial LUVISKOL VA 46-E, the manufacture of BASF) on this photoconductive layer to the extent of 0.1–20μ in dry thickness, two varieties of photosensitive materials having a 4.6μ-thick protective layer and a 16.5μ-thick protective layer, respectively, were prepared. The thus prepared photosensitive materials were so superior in flexibility that they could be easily fastened on a cylinder. When the light-decay property of these photosensitive materials was measured in the same way as in Example 16, the results were as shown in the following Table 11.

Table 11

| protective layer | light-decay property | | |
|---|---|---|---|
| | E 1/2 | E 1/5 | E 1/10 |
| none | 4.8 | 12.5 | 21.4 |
| 4.6 μ-thick layer | 4.8 | 12.7 | 21.9 |
| 16.5 μ-thick layer | 4.8 | 13.2 | 22.0 |

As is evident from the showing in this table, the sensitivity of the photosensitive materials according to the present invention was practically equal to that of a photosensitive material having no protective layer.

Next, when the image test was conducted in the same way as in Example 16, it was possible to obtain a positive image having a background free of stains and faithful to the original image. There was no deterioration of image even after producing 30,000 copies.

EXAMPLE 18

By coating a solution having the same composition and under the same condition of coating as in Example 17, a 20μ-thick organic photoconductive layer was formed on a polyester film deposited with aluminum through vacuum evaporation.

Next, by coating a 10% ethanol solution of vinyl acetate-vinyl pyrrolidone copolymer (molar ratio=70:30) (commercial LUVISKOL VA 73-E, the manufacture of BASF) on this photoconductive layer, a photosensitive material having a 20μ-thick protective layer was prepared. The thus prepared photosensitive material was so superior in flexibility that it could be easily fastened on a cylinder. Subsequently, by applying this photosensitive material a photosensitive latent image was formed according to the method disclosed in the specification for Japanese Patent Publication No. 2965/1973. To be precise, the photosensitive material was first charged with positive electricity by corona discharge of 6.5 KV, and was subjected to overall exposure simultaneously with or immediately after said electrification. The surface potential at this time was +980 V. Thereafter, the material was charged with negative electricity by corona discharge of 4.7 KV in the dark (the surface potential at this time was −780 V) and then subjected to image-like exposure under the condition of 18 lux.sec, whereby an electrostatic latent image was formed thereon. The surface potential of the exposed area at this time was +100 V, and the potential difference between the non-exposed area and the exposed area was 880 V.

Next, when this latent image was developed through the known dry-developing process or wet-developing process, electrostatically transferred to a slick paper and fixed, there was obtained a positive image free of background stains and faithful to the original image. Even after producing 30,000 copies by repeating the foregoing procedures, the photosensitive material showed no deterioration of sensitivity thereof nor disorder of image.

EXAMPLE 19

By depositing amorphous selenium containing 10% of tellurium to the extent of 50μ in thickness through vacuum evaporation on a polyester deposited with aluminum through vacuum evaporation, an organic photoconductive layer was formed. Next, by coating a 5–10 wt. % ethanol solution of vinyl acetate-vinyl pyrrolidone copolymer (molar ratio=50:50) (commercial LUVISKOL VA 55-E, the manufacture of BASF) on this photoconductive layer, two varieties of photosensitive materials having a 4.5μ-thick protective layer and a 23.5μ-thick protective layer, respectively, were prepared. When the light-decay property of the thus prepared photosensitive materials was measured in the same way as in Example 16, the results were shown in the following Table 12.

Table 12

| protective layer | light-decay property | | |
|---|---|---|---|
| | E 1/2 | E 1/5 | E 1/10 |
| none | 2.0 | 3.8 | 7.0 |
| 4.5 μ-thick layer | 2.0 | 3.9 | 7.2 |
| 23.5 μ-thick layer | 2.0 | 4.3 | 8.0 |

As is evident from the showing in this table, the sensitivity of the photosensitive materials according to the present invention was practically equal to that of a photosensitive material having no protective layer.

Next, when the image test was conducted in the same way as in Example 16, it was possible to obtain a positive image free of background stains and faithful to the original image. There was no deterioration of image even after producing 30,000 copies.

EXAMPLE 20

| | |
|---|---|
| Poly-N-vinyl carbazole | 2.0 g |
| 2,4,7-Trinitrofluorenone | 3.3 g |
| Polyester Adhesive 49,000 (the manufacture of DuPont Co.) | 0.472 g |
| Silicone Oil Ak-1,000 (the manufacture of Worker | 0.014 g |

-continued

| | |
|---|---|
| Chemical GMBH) | |
| Tetrahydrofuran | 41.7 g |

A solution having the above composition was coated on a polyester film deposited with aluminum through vacuum evaporation by the use of a doctor blade and was dried at a temperature of 60° C. for 10 minutes and at a temperature of 100° C. for 2 minutes in succession, whereby a 20μ-thick organic photoconductive layer was formed.

Meanwhile, by adding 5 g of hexamethoxymethylol melamine, 0.5 g of p-toluene sulfonic acid, 0.5 g of β-(3,4-epoxycyclohexyl)ethyl trimethoxysilane and 0.05 g of Silicone Oil KF-97 (the manufacture of SHINETSU KAGAKU K.K.) to a 10 wt. % ethanol solution of poly(butyl vinyl ether/maleic anhydride)ethyl ester (commercial Gantlets ES-225, the manufacture of GAF Co.), an overcoat solution was prepared. After adjusting the concentration of this solution to be in the range of 5–10% (in terms of the copolymer therein), by coating the thus adjusted solution on the foregoing photoconductive layer to the extent of 0.1–10μ in dry thickness two varieties of photosensitive materials having a 2.2μ-thick protective layer and an 8.3μ-thick protective layer, respectively, were prepared. The thus prepared photosensitive materials were so superior in flexibility that they could be easily fastened on a cylinder.

These photosensitive materials were charged with negative electricity by corona discharge of 6.0 KV, exposed to the light of white tungsten lamp of 20 luxes, and subjected to measurement for determining the amount of exposure E 1/2 (luxsec) required for decay of the surface potential to 1/2, the amount of exposure E 1/5 (lux.sec) required for decay of the surface potential to 1/5 and the amount of exposure E 1/10 (lux.sec) required for decay of the surface potential to 1/10, after applying the light. And, the values obtained from this measurement, which represent the sensitivity of the present photosensitive materials, were compared with the counterpart of a photosensitive material having no protective layer. The results were as shown in the following Table 13.

Table 13

| protective layer | light-decay property | | |
|---|---|---|---|
| | E 1/2 | E 1/5 | E 1/10 |
| none | 4.6 | 12.0 | 20.6 |
| 2.2 μ-thick layer | 4.6 | 12.2 | 20.6 |
| 8.3 μ-thick layer | 4.6 | 12.5 | 21.5 |

As is evident from the showing in this table, the sensitivity of the photosensitive materials according to the present invention was practically equal to that of the photosensitive material having no protective layer.

Next, when the image obtained through the known dry-developing process or wet-developing process was electrostatically transferred to a slick paper and fixed, there was obtained a positive image having no background stains and faithful to the original image. Even after producing 3,000 copies by repeating the foregoing procedures, the photosensitive materials showed no deterioration of sensitivity nor disorder of image. Meanwhile, as for the photosensitive material having no protective layer, when the image test was conducted in the same way as above, it was observed that the sensitivity deteriorated, the background of image became stained and the image became disordered when only 5,000 copies were produced. Further, the photosensitive materials having the protective layer could produce an image free of disorder and faithful to the original image even in the atmosphere of 15° C. in temperature and 20% RH as well as 30° C. in temperature and 80% RH.

EXAMPLE 21

| | |
|---|---|
| poly-N-vinyl carbazole | 2.0 g |
| 2,4,7-trinitrofluorenone | 3.3 g |
| polycarbonate | 0.472 g |
| Silicone Oil Ak-1,000 | 0.014 g |
| (the manufacture of Worker | |
| Chemical GMBH) | |
| tetrahydrofuran | 41.7 g |

A solution having the above composition was coated on a polyester film deposited with aluminum through vacuum evaporation by the use of a doctor blade and was dried at a temperature of 60° C. for 10 minutes and at a temperature of 100° C. for 2 minutes in succession, whereby an 18μ-thick organic photoconductive layer was formed. Meanwhile, by adding 5 g of hexamethoxymethylol melamine, 0.5 g of p-toluene sulfonic acid, 0.5 g of β(3,4-epoxycyclohexyl)-ethyl trimethoxysilane and 0.05 g of Silicone Oil KF-96 (the manufacture of SHINETSU KAGAKU K.K.) to a 10 wt. % isopropanol solution of poly(vutyl vinyl ether/maleic anhydride) isopropyl ester (commercial Gantlets ES-335-1, the manufacture of GAF Co.), an overcoat solution was prepared. And, after adjusting the concentration of this solution to be in the range of 5–10% (in terms of the copolymer therein), by coating the thus adjusted solution on the foregoing photoconductive layer to the extent of 0.1–20μ in dry thickness, two varieties of photosensitive materials having a 5.5μ-thick protective layer and a 16.8μ-thick protective layer, respectively, were prepared. The thus prepared photosensitive materials were so superior in flexibility that they could be easily fastened on a cylinder.

When the light-decay property of these photosensitive materials was measured in the same way as in Example 20, the results were as shown in the following Table 14.

Table 14

| protective layer | light-decay property | | |
|---|---|---|---|
| | E 1/2 | E 1/5 | E 1/10 |
| none | 4.8 | 12.5 | 21.4 |
| 5.5 μ-thick layer | 4.8 | 12.7 | 21.6 |
| 16.8 μ-thick layer | 4.9 | 13.5 | 22.0 |

As is evident from the showing this table, the sensitivity of the photosensitive materials according to the present invention was practically equal to that of a photosensitive material having no protective layer.

Next, when the image test was conducted in the same way as in Example 20, it was possible to obtain a positive image free of background stains and faithful to the original image. There was no image deterioration even after 30,000 copies. Further, in the test of wet-proof property thereof conducted in the same way as in Example 20, the present photosensitive materials produced copies faithful to the original image.

EXAMPLE 22

By coating a solution having the same composition and under the same condition of coating as in Example 21, a 20μ-thick organic photoconductive layer was formed on a polyester film deposited with aluminum through vacuum evaporation.

Next, an overcoat solution prepared by adding 5 g of butyrated malamine, 0.5 g of p-toluene sulfonic acid and 0.5 g of γ-aminopropyl triethoxysilane to a 10 wt. % ethanol solution of poly(butyl vinyl ether/maleic anhydride) butyl ester (commercial Gantlets ES-425, the manufacture of GAF Co.) was coated on the foregoing photoconductive layer, whereby a photosensitive material having a 23.6μ-thick protective layer was prepared. The thus prepared photosensitive material was so superior in flexibility that it could be fastened on a cylinder.

Subsequently, utilizing this photosensitive materials, a photosensitive latent image was formed according to the method disclosed in the specification for Japanese Patent Publication No. 2965/1973. To be precise, the photosensitive material was first charged with positive electricity by corona discharge of 6.5 KV, and was subjected to overall exposure simultaneously with or immediately after said electrification. The surface potential at this time was +1050 V. Thereafter, the material was charged with negative electricity by corona discharge of 4.7 KV in the dark (the surface potential at this time was −800 V) and then subjected to image-like exposure under the condition of 18 lux.sec, whereby an electrostatic latent image was formed thereon. The surface potential of the exposed area at this time was +90 V, and the potential difference between the non-exposed area and the exposed area was 890 V.

Next, when this latent image was developed through the known dry-developing process or wet-developing process, electrostatically transferred to a slick paper and fixed, there was obtained a positive image free of background stains and faithful to the original image.

Even after producing 30,000 copies by repeating the above procedures, the photosensitive material showed no deterioration of sensitivity nor disorder of image. Further, in the test of the wet-proof property conducted in the same way as in Example 20, it produced copies faithful to the original image.

EXAMPLE 23

By depositing amorphous selenium containing 10% of tellurium to the extent of 50μ in thickness through vacuum evaporation on a polyester film deposited with aluminum through vacuum evaporation, an organic photoconductive layer was formed. Meanwhile, by adding 5 g of butyrated malamine, 0.5 g of p-toluene sulfonic acid and 0.5 g of γ-aminopropyl triethoxysilane to a 10 wt.% isopropanol solution of poly(butyl vinyl ether/maleic anhydrice)butyl ester (commercial Gantlets ES-435, the manufacture of GAF Co.), an overcoat solution was prepared. And, after adjusting the concentration of this solution to be in the range of 5–10 wt.% (in terms of the copolymer therein), by coating the thus adjusted solution on the foregoing photoconductive layer to the extent of 0.1–20μ in dry thickness, two varieties of photosensitive materials having a 3.0μ-thick protective layer and an 18.0μ-thick protective layer, respectively, were prepared. The thus prepared photosensitive materials were so superior in flexibility that they could be fastened on a cylinder.

When the light-decay property of these photosensitive materials was measured in the same way as in Example 20, the results were as shown in the following Table 15.

Table 15

| protective layer | light-decay property | | |
|---|---|---|---|
| | E 1/2 | E 1/5 | E 1/10 |
| none | 2.0 | 3.8 | 7.0 |
| 3.0 μ-thick layer | 2.0 | 3.8 | 7.1 |
| 18.0 μ-thick layer | 2.2 | 4.0 | 8.4 |

As is evident from the showing in this table, the sensitivity of the photosensitive materials according to the present invention was practically equal to that of a photosensitive material having no protective layer.

Next, when the image test was conducted in the same way as in Example 20, it was possible to obtain a positive image free of background stains and faithful to the original image. There was no image deterioration even after producing 30,000 copies. Further, in the test of the wet-proof property conducted in the same way as in Example 20, it produced copies faithful to the original image.

EXAMPLE 24

| | |
|---|---|
| Poly-N-vinyl carbazole | 2.0 g |
| 2,4,7-Trinitrofluorenone | 3.3 g |
| Polyester Adhesive 49,000 (the manufacture of DuPont Co.) | 0.472 g |
| Silicone Oil Ak-1,000 (the manufacture of Worker Chemical GMBH) | 0.014 g |
| Tetrahydrofuran | 41.7 g |

A solution having the above composition was coated on a polyester film deposited with aluminum through vacuum evaporation by the use of a doctor blade and was dried at a temperature of 60° C. for 10 minutes and a temperature of 100° C. for 2 minutes in succession, whereby a 20μ-thick organic photoconductive layer was formed.

Meanwhile, by dissolving 10 g of ethyl acrylate-acrylic acid copolymer (molar ratio=90:10) in 90 g of isopropanol and then adding 3.5 g of hexamethoxymethylol melamine, 0.35 g of p-toluene sulfonic acid and 0.5 g of β(3,4-epoxycyclohexyl)-ethyl trimethoxysilane to the resulting solution, an overcoat solution was prepared. And, after adjusting the concentration of this solution to be in the range of 5–10% (in terms of said copolymer), by coating the thus adjusted solution on the foregoing photoconductive layer to the extent of 0.1–10μ in dry thickness, two varieties of photosensitive materials having a 1.5μ-thick protective layer and a 6.5μ-thick protective layer, respectively, were prepared. The thus prepared photosensitive materials were so superior in flexibility that they could be fastened on a cylinder.

These photosensitive materials were charged with negative electricity by corona discharge of 6.0 KV, exposed to the light of 20-lux white tungsten lamp, and subjected to measurement for determining the amount of exposure E 1/2 (lux.sec) required for decay of the surface potential to 1/2, the amount of exposure E 1/5 (lux.sec) required for decay of the surface potential to 1/5 and the amount of exposure E 1/10 (luxsec) required for decay of the surface potential to 1/10, after applying the light. The values obtained from this measurement, which represent the sensibility of the present photosensitive materials, were compared with the counterpart of a photosensitive material having no protective layer. The results are shown in the following Table 16.

Table 16

| protective layer | light-decay property | | |
|---|---|---|---|
| | E 1/2 | E 1/5 | E 1/10 |
| none | 4.6 | 12.0 | 20.6 |
| 1.5 μ-thick layer | 4.6 | 12.1 | 20.8 |
| 6.5 μ-thick layer | 4.6 | 12.1 | 21.0 |

As is evident from the showing in this table, the sensitivity of the photosensitive materials according to the present invention was practically equal to that of a photosensitive material having no protective layer.

Next, when the image obtained through the known dry-developing process or wet-developing process was electrostatically transferred to a slick paper and fixed, there was obtained a positive image having no background stains and faithful to the original image. Even after producing 30,000 copies by repeating the foregoing procedures, the photosensitive materials showed no deterioration of sensitivity nor disorder of image. While, as for the photosensitive material having no protective layer, when the image test was conducted in the same way as above, it was observed that the sensitivity deteriorated, the background of image became stained and the image became disordered when only 5,000 copies were produced. Further, the photosensitive materials having the protective layer produced an image free of disorder and faithful to the original image in an atmosphere of 15° C. in temperature and 20% RH as well as 30° C. in temperature and 80% RH.

EXAMPLE 25

By coating a solution having the same composition as in Example 24 on a polyester film deposited with aluminum through vacuum evaporation by the use of a doctor blade and drying at a temperature of 60° C. for 10 minutes and at a temperature of 100° C. for 2 minutes in succession, and 18μ-thick organic photoconductive layer was formed.

Meanwhile, by dissolving 10 g of methyl methacrylate-glycidyl methacrylate-tert-butyl methacrylate copolymer (molar ratio=85:10:5) in 90 g of n-butanol and then adding 4.0 of butyrated melamine, 0.4 g of p-toluene sulfonic acid and 2.0 g of γ-aminopropyl trioxysilane to the resulting solution, an overcoat solution was prepared. And, after adjusting the concentration of this solution to be in the range of 5–10% (in terms of said copolymer), by coating the thus adjusted solution on the foregoing photoconductive layer to the extent of 0.1–20μ in dry thickness, two varieties of photosensitive materials having a 2.0μ-thick protective layer and a 16.5μ-thick protective layer, respectively, were prepared. The thus prepared photosensitive materials were so superior in flexibility that they could be fastened on a cylinder.

These photosensitive materials were charged with negative electricity by corona discharge of 6.0 KV, exposed to the light of 20-lux white tungsten lamp, and subjected to measurement for determining the amount of exposure E 1/2 (lux.sec) required for decay of the surface potential to 1/2, the amount of exposure E 1/5 (lux.sec) required for decay of the surface potential to 1/5 and the amount of exposure E 1/10 (lux.sec) required for decay of the surface potential to 1/10, after applying the light. And, the values obtained from this measurement, which represent the sensitivity of the present photosensitive material, were compared with the counterpart of a photosensitive material having no protective layer. The results are shown in the following Table 17.

Table 17

| protective layer | light-decay property | | |
|---|---|---|---|
| | E 1/2 | E 1/5 | E 1/10 |
| none | 4.7 | 12.5 | 21.6 |
| 2.0 μ-thick layer | 4.7 | 12.7 | 21.6 |
| 16.5 μ-thick layer | 4.8 | 13.1 | 22.5 |

As is evident from the showing in this table, the sensitivity of the photosensitive materials according to the present invention was practically equal to that of a photosensitive material having no protective layer.

Next, when the image test was conducted in the same way as in Example 20, it was possible to obtain a positive image free of background stains and faithful to the original image. There was no deterioration of image even after producing 30,000 copies. Further, in the test of the wet-proof property conducted in the same way as in Example 24, it produced copies faithful to the original image.

EXAMPLE 26

By coating a solution having the same composition and under the same condition of coating as in Example 24, a 20μ-thick organic photoconductive layer was formed on a polyester film deposited with aluminum through vacuum evaporation.

Next, an overcoat solution prepared by adding 3.0 g of γ-glycidoxy-3,3-dimethyl-1-propenyl trimethoxysilane to a 10 wt.% polybutyl methacrylate was coated on the foregoing photoconductive layer to the extent of 0.1–20μ in dry thickness, whereby two varieties of photosensitive materials having a 2.0μ-thick protective layer and an 18.0μ-thick protective layer, respectively, were prepared. When the light-decay property of the thus prepared photosensitive materials was measured in the same way as in Example 24, the results are as shown in the following Table 18.

Table 18

| protective layer | light-decay property | | |
|---|---|---|---|
| | E 1/2 | E 1/5 | E 1/10 |
| none | 4.6 | 12.0 | 20.6 |
| 2.0 μ-thick layer | 4.6 | 12.1 | 20.5 |
| 18.0 μ-thick layer | 4.6 | 12.6 | 21.8 |

As is evident from the showing in this table, the sensitivity of the photosensitive materials according to the present invention was practically equal to that of a photosensitive material having no protective layer.

Next, when the image test was conducted in the same way as in Example 24, it was possible to obtain a positive image free of background stains and faithful to the original image. There was no deterioration of image even after producing 30,000 copies.

Further, in the test of the wet-proof property conducted in the same way as in Example 24, they produced copies faithful to the original image.

EXAMPLE 27

By depositing amorphous selenium containing 10% of tellurium to the extent of 50μ in thickness through vacuum evaporation on a polyester film deposited with aluminum through vacuum evaporation, an inorganic photoconductive layer was formed. Next, an overcoat solution prepared by adding 30 g of β(3,4-epoxycyclohexyl)-ethyl trimethoxysilane to a 10% n-butanol solution of polyacrylonitrile was coated on the foregoing photoconductive layer to the extent of 0.1–30.0μ in dry thickness, whereby two varieties of photosensitive materials having a 5.0μ-thick protective layer and a 22.3μ-thick protective layer, respectively, were prepared.

When the light-decay property of the thus prepared photosensitive materials was measured in the same way as in Example 24, the results were as shown in the following Table 19.

Table 19

| protective layer | light-decay property | | |
|---|---|---|---|
| | E 1/2 | E 1/5 | E 1/10 |
| none | 2.0 | 3.8 | 7.0 |
| 5.0 μ-thick layer | 2.0 | 3.8 | 7.0 |
| 22.3 μ-thick layer | 2.0 | 4.5 | 8.0 |

As is evident from the showing in this table, the sensitivity of the photosensitive materials according to the present invention was practically equal to that of a photosensitive material having no protective layer.

Next, when the image test was conducted in the same way as in Example 24, it was possible to obtain a positive image having no background stains and faithful to the original image. There was no image deterioration even after producing 30,000 copies.

Further, in the test of the wet-proof property conducted in the same way as in Example 24, they produced copies faithful to the original image.

EXAMPLE 28

| | |
|---|---|
| Poly-N-vinyl carbazole | 2.0 g |
| 2,4,7-Trinitrofluorenone | 3.3 g |
| Polyester Adhesive 49,000 (the manufacture of DuPont Co.) | 0.472 g |
| Silicone Oil Ak-1,000 (the manufacture of Worker Chemical GMBH) | 0.014 g |
| Tetrahydrofuran | 41.7 g |

A solution having the above composition was coated on a polyester film deposited with aluminum through vacuum evaporation by the use of a doctor blade and was dried at a temperature of 100° C. for 2 minutes in succession, whereby a 18μ-thick organic photoconductive layer was formed.

Next, by adding 5 g of hexamethoxymethylol melamine, 0.5 g of p-toluene sulfonic acid, 0.5 g of vinyltriacetoxysilane and 0.05 g of Silicone Oil KF-96 (the manufacture of SHINETSU KAGAKU K.K.) to a 100 g of 10 wt.% methanol solution of butyral resin (the manufacture of SEKISUI KAGAKU K.K.; trade name S-LEC BM-2), an overcoat solution was prepared.

And further, after adjusting the concentration of this solution to be in the range of 5–10 wt.% by the use of methanol, by coating the thus adjusted solution to the extent of 10–20μ in dry thickness, whereby a transparent protective layer was formed. The resulting photosensitive material was so superior in flexibility that it could be fastened on a cylinder.

The thus prepared photosensitive material was charged with positive electricity by corona discharge of 6.5 KV and was subjected to overall exposure simultaneously with or immediately after said electrification. The surface potential at this time was +1040 V. Subsequently, by charging negative electricity by corona discharge of 4.7 KV in the dark (the surface potential at this time was −600 V) and then subjecting to image-like exposure under the condition of 18 lux.sec, an electrostatic latent image was formed on the photosensitive material. The surface potential at this time was +140 V, and the potential difference between the non-exposed area and the exposed area was 740 V.

Next, when the image produced through dry-developing process or wet-developing process according to the known methods was electrostatically transferred to a slick paper and fixed, there was obtained a positive image having no background stains and faithful to the original image. Even after producing 10,000 copies by repeating the above procedures, there was observed no loss of sensitivity or image disorder.

EXAMPLE 29

By coating a solution having the same composition and under the same condition of coating as in Example 28, a 20μ-thick organic photoconductive layer was formed on a polyester film deposited with aluminum through vacuum evaporation.

Next, by adding 5 g of hexamethoxymethylol melamine, 0.5 g of p-toluene sulfonic acid and 0.5 g of γ-chloropropyl-trimethoxysilane to a 100 g of 10 wt.% methanol solution of polyvinyl acetate resin (the manufacture of DAICEL Co., Ltd.; trade name SEVIAN A-001), an overcoat solution was prepared.

And further, after adjusting the concentration of this solution to be in the range of 5–10 wt.% by the use of methanol, by coating the thus adjusted solution to the extent of 10–20μ in dry thickness, whereby a transparent protective layer was formed. The resulting photosensitive material was so superior in flexibility that it could be fastened on a cylinder.

The thus prepared photosensitive material was charged with positive electricity by corona discharge of 6 KV and was subjected to overall exposure simultaneously with or immediately after said electrification. The surface potential at this time was 1080 V. Subsequently, by charging negative electricity by corona discharge of 5.3 KV in the dark (the surface potential at this time was −750 V) and then subjecting to image-like exposure under the condition of 18 lux.sec, an electrostatic latent image was formed on the photosensitive material. The surface potential at this time was 120 V, and the potential difference between the non-exposed area and the exposed area was 870 V.

Next, when the image produced through dry-developing process or wet-developing process according to the known methods was electrostatically transferred to a slick paper and fixed, there was obtained a positive image free of background stains and faithful to the original image. Even after producing 10,000 copies by repeating the above procedures, there was observed no loss of sensitivity or image disorder.

What is claimed is:

1. A photosensitive material for use in electrophotography comprising an electrically conductive support having a photoconductive layer overcoated thereon with a protective layer wherein said protective layer is composed of a film forming, transparent resin and, based on the total weight of the protective layer, from about 0.01 wt.% to 10 wt.% of a silane-coupling agent.

2. A photosensitive material according to claim 1, wherein said resin is a member selected from the group consisting of polyvinyl butyral, polyvinyl acetate, acrylic or derivative resins thereof, copolymers of styrene and maleic anhydride or alkyl esters thereof, copolymers of vinyl acetate or derivatives thereof and vinyl pyrrolidone, copolymers of butyl vinyl ether and maleic anhydride or alkyl monoesters thereof, shellac, polyamides, polyvinyl pyrrolidones, polyvinyl alcohols, polyvinyl acetals and cellulose.

3. A photosensitive material according to claim 1, wherein said silane-coupling agent is at least one member selected from the group consisting of vinyl chlorosilane, vinyl triethoxysilane, vinyl trimethoxsilane, vinyl-tris ($\beta$-methoxyethoxy)silane, $\gamma$-methacryl oxypropyl trimethoxysilane, $\gamma$-methacryl oxypropyl tris($\beta$-methoxycthoxy)silane, $\beta$-(3,4-epoxycyclohexyl)ethyl trimethoxysilane, $\gamma$-glycidoxypropyl methoxysilane, $\gamma$-aminopropyl triethoxysilane, N-$\beta$-(aminoethyl)-$\gamma$-aminopropyl trimethoxysilane, N-$\beta$-(aminoethyl)-$\gamma$-aminopropyl methyl dimethoxysilane, N-N-bis($\beta$-hydroxyethyl)-$\gamma$-aminopropyl triethoxysilane and $\gamma$-chloropropyl trimethoxysilane.

4. A photosensitive material according to claim 1, wherein said protective layer additionally contains an adhesive which is at least one member selected from the group consisting of polyvinyl butyral, polyvinyl alcohol, polyvinyl chloride, polyvinyl acetate, acrylic resins, epoxide resins, urea resins and urethane resins, and a cross-linking agent which is at least one member selected from the group consisting of aminotriazines, epoxide resins, and urethane resins.

5. A photosensitive material according to claim 4, wherein said cross-linking agent is aminotriazine.

6. A photosensitive material according to claim 1, wherein said protective layer additionally contains a curing catalyst which is at least one member selected from the group consisting of sulfuric acid, paratoluene sulfonic acid and 1-naphthalene sulfonic acid.

7. A photosensitive material according to claim 1, wherein said protective layer contains silicone oil as a wetting agent.

8. A photosensitive material according to claim 1, wherein said protective layer additionally contains at least one member selected from the group consisting of quartz sand, glass fiber, amorphous or crystal silica and metal oxide.

* * * * *